US006180907B1

(12) United States Patent
Dufournet

(10) Patent No.: US 6,180,907 B1
(45) Date of Patent: Jan. 30, 2001

(54) LIMITER DEVICE FOR A HIGH VOLTAGE CIRCUIT BREAKER HAVING A GROUNDED METAL TANK

(75) Inventor: Denis Dufournet, Bron (FR)

(73) Assignee: Alstom France SA, Paris (FR)

( * ) Notice: Under 35 U.S.C. 154(b), the term of this patent shall be extended for 0 days.

(21) Appl. No.: 09/334,605

(22) Filed: Jun. 17, 1999

(30) Foreign Application Priority Data

Jun. 19, 1998 (FR) ..... 98 07762

(51) Int. Cl.[7] ..... H01H 33/16; H01H 73/00
(52) U.S. Cl. ..... 218/145; 361/115
(58) Field of Search ..... 218/55, 79, 143, 218/144, 145, 82; 361/1, 2, 13, 115

(56) References Cited

U.S. PATENT DOCUMENTS 3,411,038 * 11/1968 Lee ..... 218/145 X
3,842,225 * 10/1974 Leeds ..... 218/143
4,103,128 * 7/1978 Kosaku ..... 218/145
4,810,840 3/1989 Okuno ..... 218/145
5,039,831 * 8/1991 Sato et al. ..... 218/144
5,266,758 * 11/1993 Pham et al. ..... 218/144
5,821,496 * 10/1998 Mizufune et al. ..... 218/145

FOREIGN PATENT DOCUMENTS 0 482 555 A1 4/1992 (EP) .

* cited by examiner

*Primary Examiner*—J. R. Scott
(74) *Attorney, Agent, or Firm*—Sughrue, Mion, Zinn, Macpeak & Seas, PLLC

(57) ABSTRACT

A limiter device for a "dead tank" high voltage circuit breaker having a grounded metal tank, the circuit breaker having two terminals for connection respectively to a high voltage electricity line and to a link leading to a source that is situated upstream and that enables the line to be fed via the circuit breaker. It comprises a capacitor placed outside the tank of the circuit breaker and which is electrically connected between the two terminals of the circuit breaker to limit voltage recovery speeds both upstream and downstream of the circuit breaker, following an interruption due to a line fault.

4 Claims, 2 Drawing Sheets

LIMITER DEVICE FOR A HIGH VOLTAGE CIRCUIT BREAKER HAVING A GROUNDED METAL TANK

The invention relates to a limiter device for a high voltage circuit breaker of the "dead tank" type, i.e. having a grounded metal tank, the circuit breaker being placed upstream on a high voltage electricity line in an electricity transport or distribution network, and more particularly the invention relates to a device for limiting the speed of voltage recovery after being interrupted due to a line fault.

BACKGROUND OF THE INVENTION

As is known, a high voltage circuit breaker placed upstream on a high voltage electricity line must be capable of interrupting line faults that can happen downstream at distances of as much as several kilometers and that are characterized by very high levels of current. For example, when operating with 145 kV at 60 Hz, the current can be at great at 57 kA.

A problem which arises after an interruption due to a fault of that kind lies in satisfying the conditions laid down at network level for voltage recovery, and in particular the conditions relating to the speed du/dt at which voltage recovers. For example, in the above-envisaged context of 145 kV at 60 Hz, it can be required that voltage recovery takes place at a speed of 13.6 kv/$\mu$s.

Since circuit breakers are not capable, at present, of complying with such a constraint, it is conventional to provide a capacitor between ground and the line downstream from a circuit breaker so an to limit the speed at which voltage recovers to a value that is lower than the value which can be withstood by the circuit breaker. Nevertheless, the capacitor provided in such a device can be effective only for reducing a recovery voltage downstream from the circuit breaker, and it has no effect on the upstream or "source-side" voltage.

A dead tank circuit breaker is connected directly to a feed busbar on the upstream side and has no significant capacitance capable of acting thereon, the capacitance of the outlet feeder being small, of the order of 50 pF to 100 pF. It must nevertheless be capable of withstanding the sum of the voltage recoveries both upstream and downstream.

In the above-mentioned example of a network, a usual value for the speed du/dt of upstream voltage recovery is 2 kV/$\mu$s to 7.8 kV/$\mu$s, with the value for the speed of downstream voltage recovery being 13.6 kV/$\mu$s. The high value for the upstream voltage recovery speed, i.e. 7.8 kV/$\mu$s, is the consequence of high frequency voltage oscillation due to reflections on the first major discontinuity present in the set of busbars linked to the source.

Even if it is possible to envisage halving the speed of downstream voltage recovery by installing a capacitor of high capacitance, e.g., 6 nF to 12 nF for a 145 kV line, it nevertheless remains that the voltage recovery speed at the terminals of the circuit breaker remains very high and much greater than that which can be accepted by a circuit breaker when breaking.

It is also possible to place a capacitor between a phase and ground on the source side, upstream from a circuit breaker in order to reduce the speed of upstream voltage recovery to a value which is compatible with the limit set, i.e. a capacitor in addition to the above-mentioned capacitor placed on the line side. Nevertheless, that solution is not to be recommended since it can be highly damaging if failure of the capacitor upstream from the circuit breaker gives rise to a ground fault.

OBJECTS AND SUMMARY OF THE INVENTION

The invention thus proposes a limiter device for a "dead tank" high voltage circuit breaker having a metal tank which is grounded, the circuit breaker including two terminals for connection respectively to a high voltage electricity line and to a link terminating at a source which enables the line to be fed via the circuit breaker, the device serving to limit the speed of voltage recovery after an interruption caused by a line fault.

According to a characteristic of the invention, the circuit breaker comprises a capacitor which is placed outside the circuit breaker tank and which is electrically connected between the two terminals of the circuit breaker to limit the voltage recovery speeds both upstream and downstream of the circuit breaker, following an interruption due to a line fault.

BRIEF DESCRIPTION OF THE DRAWINGS

The invention, its characteristics, and its advantages are described in greater detail in the following description with reference to the figures mentioned below.

MORE DETAILED DESCRIPTION

Figure 1:
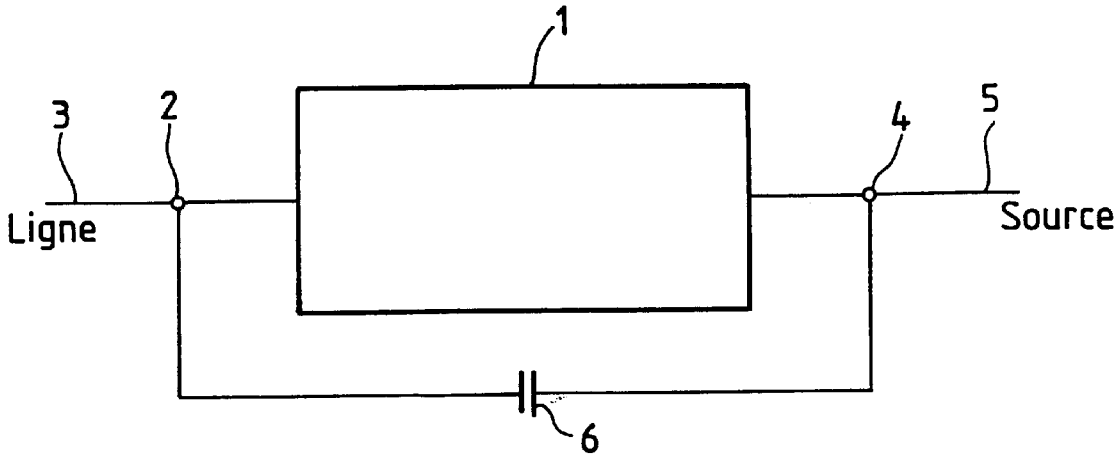
FIG. 1 is a theoretical schematic including a device of the invention.

The schematic of FIG. 1 shows a high voltage circuit breaker 1 of the "dead tank" type that is connected downstream from a source and upstream from a high voltage electricity line which is fed via the circuit breaker. Externally, the circuit breaker has a terminal 2 for connection to a wire 3 of an overhead high voltage line, and a terminal 4 for connection via a conductive feeder busbar link 5 to a source.

By way of example, the circuit breaker may be an HGF1012 or 1014 model made by GEC Alsthom.

A limiter device is associated with the circuit breaker 1 so as to keep the voltage recovery speed to an acceptable value, during voltage recovery, after it has been interrupted by the circuit breaker due to a fault appearing on the line sufficient to have triggered the circuit breaker.

According to the invention, a limiter device is provided comprising solely a capacitor 6 connected between the terminals 2 and 4 of the circuit breaker so as to be connected both to the wire 3 and to the conductive busbar 4.

This disposition makes it possible to reduce the voltage recovery speed du/dt on the upstream side of the circuit breaker 1 in the event of recovery and during the initial transient recovery voltage stage (ITRV). It also makes it possible to reduce the recovery speed du/dt on the downstream side during the first voltage recovery rise on the line.

Figure 2:
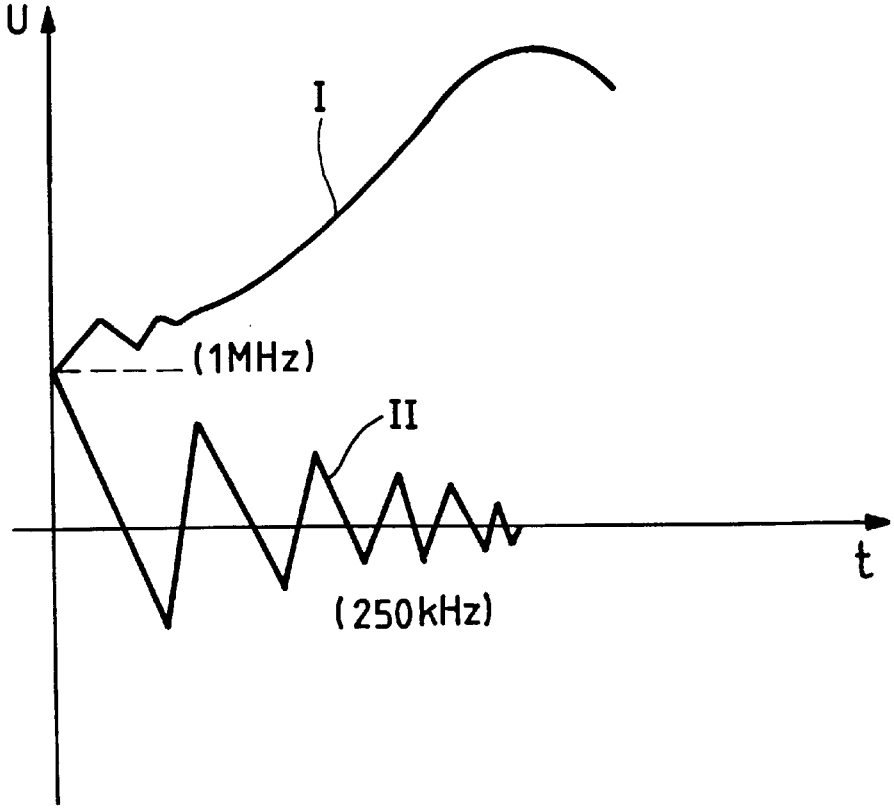
FIG. 2 is a graph showing how voltage varies (du/dt) both upstream and downstream during voltage recovery.

The voltage components of the voltage recovery transient signal during such recovery do not have the same natural frequencies, as shown diagrammatically in the voltage graph given by way of example in FIG. 2. The frequency on the upstream side is of megahertz order (curve I) while the frequency on the downstream side is of the order of 250 kHz (curve II) for a circuit breaker shown without any capacitor limiter device.

This means that the capacitor 6 of the limiter device of the invention is effective both for reducing downstream recovery speed and for reducing upstream recovery speed. Because of the position it occupies, the capacitance of the capacitor 6 can be smaller than the sum of the capacitances of the other capacitors provided upstream and downstream of the circuit breaker. It is no longer necessary to mount one or more capacitors upstream and/or downstream of the circuit breaker, thereby avoiding the drawbacks that stem therefrom.

Figure 3:
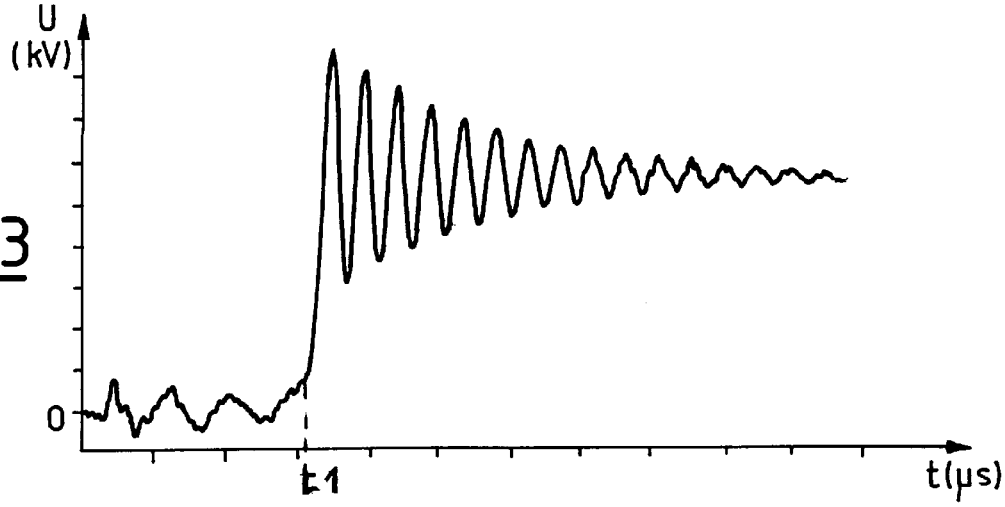
FIGS. 3, 4, and 5 are three oscillographs relating to an embodiment of the limiter device of the invention.

The test oscillograph shown by way of example in FIG. 3 shows how the initial transient recovery voltage ITRV varies. This is influenced essentially by the electrical characteristics specific to the feeder busbar set of which the conductive busbar 5 connected to the upstream terminal 4 of the circuit breaker 1 under consideration forms a part.

This oscillograph has abscissa values measured in microseconds and ordinate values corresponding to kilovolts. It shown clearly the steep slope du/dt which characterizes the initial phase of voltage recovery starting at time t1, following a very small number of low amplitude oscillations and preceding a stage of damped oscillations returning to normal conditions at the end of recovery.

Figure 4:
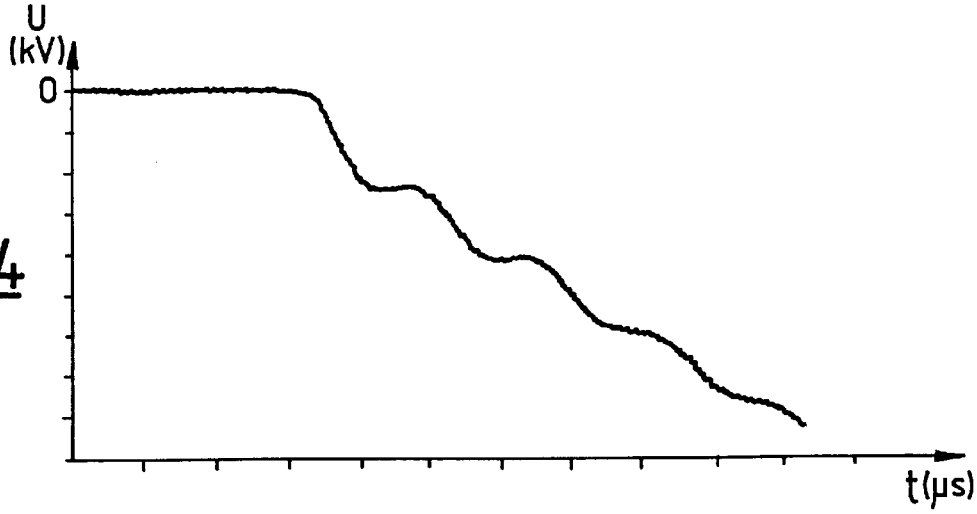

The oscillograph shown in FIG. 4 illustrates an example of the recovery transient voltage across the terminals of the circuit, when no account is taken of the initial transient recovery voltage ITRV. This curve of voltage as a function of time is plotted using the same units of voltage and of time as the preceding curve. The transient voltage is the sum of a low frequency component due to source side voltage recovery and a high frequency component due to line side voltage recovery.

Figure 5:
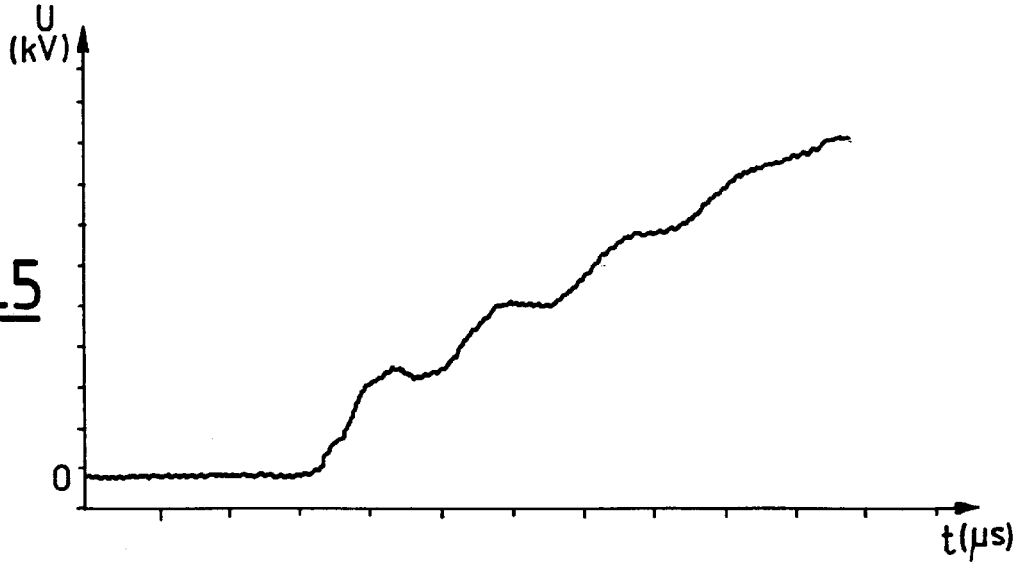

FIG. 5 corresponds to the real situation where there is simultaneously an initial recovery transient voltage ITRV of the type shown in FIG. 3 upstream from the circuit breaker and voltage oscillation of oscillating appearance due to the line downstream from the circuit breaker, with this oscillatory appearance being of the type shown in FIG. 4.

This curve is characterized by very high voltage recovery speed and by the fact that the voltage recovers without delay starting from the break instant.

The device of the invention where the capacitor 6 is connected across the terminals of the circuit breaker 1 is more particularly advantageous when the required level of performance is high. This is the case, for example, when the design current at 145 kV and 60 Hz is as great as 63 kA, making it difficult to obtain an acceptable recovery speed an the upstream side of the circuit breaker 6.

By way of example, the capacitance of a capacitor 6 is selected to be about 1 nF to 5 nF. For example, for a circuit breaker designed to operate under the conditions mentioned above and capable of interrupting a line fault corresponding to 90% at 63 kA, a capacitor 6 of 5 nF capacitance will be installed, The capacitor makes it possible to reduce the recovery speed of 13.8 kV/μs to 6.6 kV/μs on the downstream side of the circuit breaker and on the upstream side it reduces the speed from 7.8 kV/μs to 2.7 kV/μs.

The capacitance of the capacitor can be further reduced by appropriate dimensioning of the active portions of the circuit breaker 1. Such reduction requires the interrupter chamber of the circuit breaker 1 to have corresponding performance, with the required increase in performance itself increasing with decreasing capacitance. Capacitances of 600 pF, or more usually 1000 pF to 1500 pF, are entirely possible.

The capacitor 6 is mounted outside the circuit breaker 1, and more precisely outside its sealed tank so as to avoid increasing the size of the metal tank and the cost of the circuit breaker.

What is claimed is:

1. A limiter device for a dead tank circuit breaker, the circuit breaker comprising a grounded metal tank, a first external terminal for connection to a high voltage electricity line that is situated downstream from the circuit breaker and a second external terminal for connection to a link leading to a source that is situated upstream from the circuit breaker, the device comprising a capacitor disposed outside the tank of the circuit breaker and electrically connected between the first and second terminals of the circuit breaker to limit voltage recovery speeds both upstream and downstream of the circuit breaker, following an interruption by the circuit breaker due to a line fault.

2. In combination:

a high voltage circuit breaker comprising:

a grounded metal tank;

a first external terminal disposed on the tank for connection to a high voltage electricity line that is situated downstream from the circuit breaker; and a second external terminal disposed on the tank for connection to a link leading to a source that is situated upstream from the circuit breaker; and a limiter device connected between the first and second terminals on the outside of the tank of the circuit breaker to limit voltage recovery speeds both upstream and downstream of the circuit breaker, following an interruption by the circuit breaker due to a line fault.

3. The combination according to claim 2, wherein the limiter device comprises a capacitor.

4. The combination according to claim 2, wherein the high voltage circuit breaker is a dead tank circuit breaker.

* * * * *